US010157568B2

(12) United States Patent
Bang

(10) Patent No.: US 10,157,568 B2
(45) Date of Patent: Dec. 18, 2018

(54) IMAGE PROCESSING METHOD, IMAGE PROCESSING CIRCUIT, AND ORGANIC LIGHT EMITTING DIODE DISPLAY DEVICE USING THE SAME

(71) Applicant: LG Display Co., Ltd., Seoul (KR)

(72) Inventor: Sung-Jin Bang, Seoul (KR)

(73) Assignee: LG Display Co., Ltd., Seoul (KR)

( * ) Notice: Subject to any disclaimer, the term of this patent is extended or adjusted under 35 U.S.C. 154(b) by 424 days.

(21) Appl. No.: 14/957,541

(22) Filed: Dec. 2, 2015

(65) Prior Publication Data

US 2016/0351115 A1 Dec. 1, 2016

(30) Foreign Application Priority Data

May 28, 2015 (KR) ..... 10-2015-0074987

(51) Int. Cl.
*G09G 3/3208* (2016.01)
*G09G 3/20* (2006.01)
*G09G 3/3233* (2016.01)

(52) U.S. Cl.
CPC ..... *G09G 3/3208* (2013.01); *G09G 3/2003* (2013.01); *G09G 3/3233* (2013.01); *G09G 2300/0452* (2013.01); *G09G 2320/0257* (2013.01); *G09G 2320/046* (2013.01); *G09G 2320/0626* (2013.01)

(58) Field of Classification Search
CPC .. G09G 3/3208; G09G 3/3233; G09G 3/2003; G09G 2320/046; G09G 2300/0452; G09G 2320/0257; G09G 2320/0626
See application file for complete search history.

(56) References Cited

U.S. PATENT DOCUMENTS

2006/0268003 A1* 11/2006 Tanase ..... G09G 3/2003 345/603
2007/0109284 A1* 5/2007 Yamazaki ..... G09G 3/20 345/204
2007/0242006 A1 10/2007 Lin
2014/0071189 A1 3/2014 Park et al.

FOREIGN PATENT DOCUMENTS

CN 101510389 A 8/2009
CN 102810293 A 12/2012
CN 103456280 A 12/2013
CN 103854606 A 6/2014
KR 10-2013-0024371 3/2013

OTHER PUBLICATIONS

Extended European Search Report for European Patent Application No. EP 15200740.7, dated Oct. 10, 2016, 9 pages.
State Intellectual Property Office of the People's Republic of China, First Office Action, Chinese Patent Application No. 201510944731.6, dated May 2, 2018, 11 pages.

* cited by examiner

*Primary Examiner* — Kenneth Bukowski
(74) *Attorney, Agent, or Firm* — Fenwick & West LLP

(57) ABSTRACT

Embodiments relate to reducing a ghost image effect caused by fixed images. In a region of the image with an opaque fixed image, a use rate (or intensity) of a color component with a lower luminous efficacy is decreased while a use rate (or intensity) of a color component with a higher luminous efficacy is increased to maintain the luminance. By reducing an excessive use of sub-pixels corresponding to a color component of the lower luminous efficacy, the deterioration of these sub-pixels can be reduced despite presenting a fixed image on the same region of the display.

18 Claims, 7 Drawing Sheets

| KIND | GRAY SCALE DISTRIBUTION OF LOGO | MAX/MIN/AVG |
|---|---|---|
| OPAQUE LOGO |   | 253/201/225 |
| SEMITRAN -SPARENT LOGO |   | 166/73/108 |

IMAGE PROCESSING METHOD, IMAGE PROCESSING CIRCUIT, AND ORGANIC LIGHT EMITTING DIODE DISPLAY DEVICE USING THE SAME

CROSS-REFERENCE TO RELATED APPLICATION

This application claims the benefit of Korean Patent Application No. 10-2015-0074987 filed on May 28, 2015, which is hereby incorporated by reference as if fully set forth herein.

BACKGROUND OF THE INVENTION

Field of the Invention

The present invention relates to a display device, and more particularly to an image processing method and an image processing circuit that are capable of reducing deterioration and color distortion of a fixed image region and extending a lifespan of the image processing circuit, and an organic light emitting diode display device using the same.

Discussion of the Related Art

Representative examples of flat panel display devices include a liquid crystal display (LCD) device, an organic light emitting diode (OLED) display device using OLEDs, an electrophoretic display (EPD) device using electrophoretic particles. Among these flat panel display devices, the OLED display device uses an OLED element, which is configured such that an organic light emission layer between an anode and a cathode emits light itself on the basis of individual sub-pixels. Consequently, the OLED display device exhibits excellent image quality, including a high contrast ratio, and therefore has been spotlighted as a next-generation display device in various field ranging from small-sized mobile devices to large-sized TVs.

In the OLED display device, however, the OLED elements deteriorate over time due to self-emission of the OLED elements. As a result, the luminance of the OLED elements is lowered. Particularly, in a fixed image region where a fixed non-moving image is displayed for a long time (e.g., a menu or icon of a mobile device), the OLED elements emit light based on high gray scale data for a long time. As a result, the OLED elements are rapidly deteriorated, and luminance is lowered, whereby a screen burn-in problem occurs.

In order to solve this problem, a technology has been adopted in an OLED display device to correct luminance for data of the fixed image region on a per pixel basis. The luminance correction method of the related art improves image quality for a short period. However, luminous efficacies of sub-pixels having different colors are not taken into account. As a result, OLED elements of a color having lower luminous efficacy deteriorate relatively rapidly. This causes color distortion. In addition, in the luminance correction method of the related art, deterioration of the OLED elements is accelerated by luminance correction, which shortens the lifespan of the display device.

SUMMARY OF THE INVENTION

Embodiments related to processing of image data for displaying on a display device. A first image region of the image data and a second image region of the image data is determined. The first image region is more likely to cause a ghost image effect than the second image region. The image data is represented by first color components. A first conversion algorithm is applied to first pixel data of the first image region to obtain first converted pixel data represented by second color components. The number of the second color components is more than the number of the first color components. A second conversion algorithm is applied to second pixel data of the second image region to obtain second converted pixel data represented by the second color components. The first conversion algorithm increases a use rate of a first component of the second color components and decreases a use rate of a second component of the second color components relative to the second conversion algorithm. The first component has a higher luminous efficacy than the second component.

In one embodiment, the ratio of decrease in the use rate of the second component relative to the increase in the use rate of the first component corresponds to a ratio of luminous efficacies of the first component and the second component. In one embodiment, the first image region includes an opaque fixed image and the second image region does not include a fixed image.

In one embodiment, the image data includes a third image region including a semitransparent fixed image. The second conversion algorithm is applied to third pixel data of the third image region to obtain the third converted pixel data.

In one embodiment, a gray scale distribution is used to distinguish the first image region and the third image region.

In one embodiment, the first color components are red, green and blue, and the second color components are white, red, green and blue.

In one embodiment, the first component is white and the second component is blue.

In one embodiment, the first conversion algorithm generates $\alpha$ times the use rate of blue and $\beta$ times the use rate of white relative to the second conversion algorithm, where $\beta=1+\frac{1}{30}*(1-\alpha)$.

In one embodiment, the first pixel data and the second pixel data are synthesized into a converted image data.

Embodiments also relate to an image processing circuit a first image region detection unit, a first data conversion unit and a second data conversion unit. The fixed image region detection unit determines a first image region of the image data and a second image region of the image data. The first image region more likely to cause a ghost image effect compared to the second image region, the image data represented by first color components. The first data conversion unit applies a first conversion algorithm to first pixel data of the first image region to obtain first converted pixel data represented by second color components. The number of the second color components is more than a number of the first color components, The second data conversion unit applies a second conversion algorithm to second pixel data of the second image region to obtain second converted pixel data represented by the second color components. The first conversion algorithm increases a use rate of a first component of the second color components and decreases a use rate of a second component of the second color components relative to the second conversion algorithm. The first component has a higher luminous efficacy than the second component.

Embodiments also relate to a display device including an organic light emitting diode (OLED) display panel, a gate driver, an image processing circuit and a data driver. The OLED display panel includes gate lines, data lines intersecting with the gate lines and OLEDs. The gate driver generates gate control signals transmitted on the gate lines. The image processing circuit includes a fixed image region, a first data conversion unit and a second data conversion unit. The fixed image region detection unit determines a first image region of an image data and a second image region of the image data, the first image region more likely to cause a ghost image effect compared to the second image region. The image data is represented by first color components. The first data conversion unit applies a first conversion algorithm to first pixel data of the first image region to obtain first converted pixel data represented by second color components. The number of the second color components is more than a number of the first color components. The second data conversion unit applies a second conversion algorithm to second pixel data of the second image region to obtain second converted pixel data represented by the second color components. The first conversion algorithm increases a use rate of a first component of the second color components and decreases a use rate of a second component of the second color components relative to the second conversion algorithm. The first component has a higher luminous efficacy than the second component. The data driver generates analog pixel data corresponding to the first and second converted pixel data for transmitting on the data lines.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
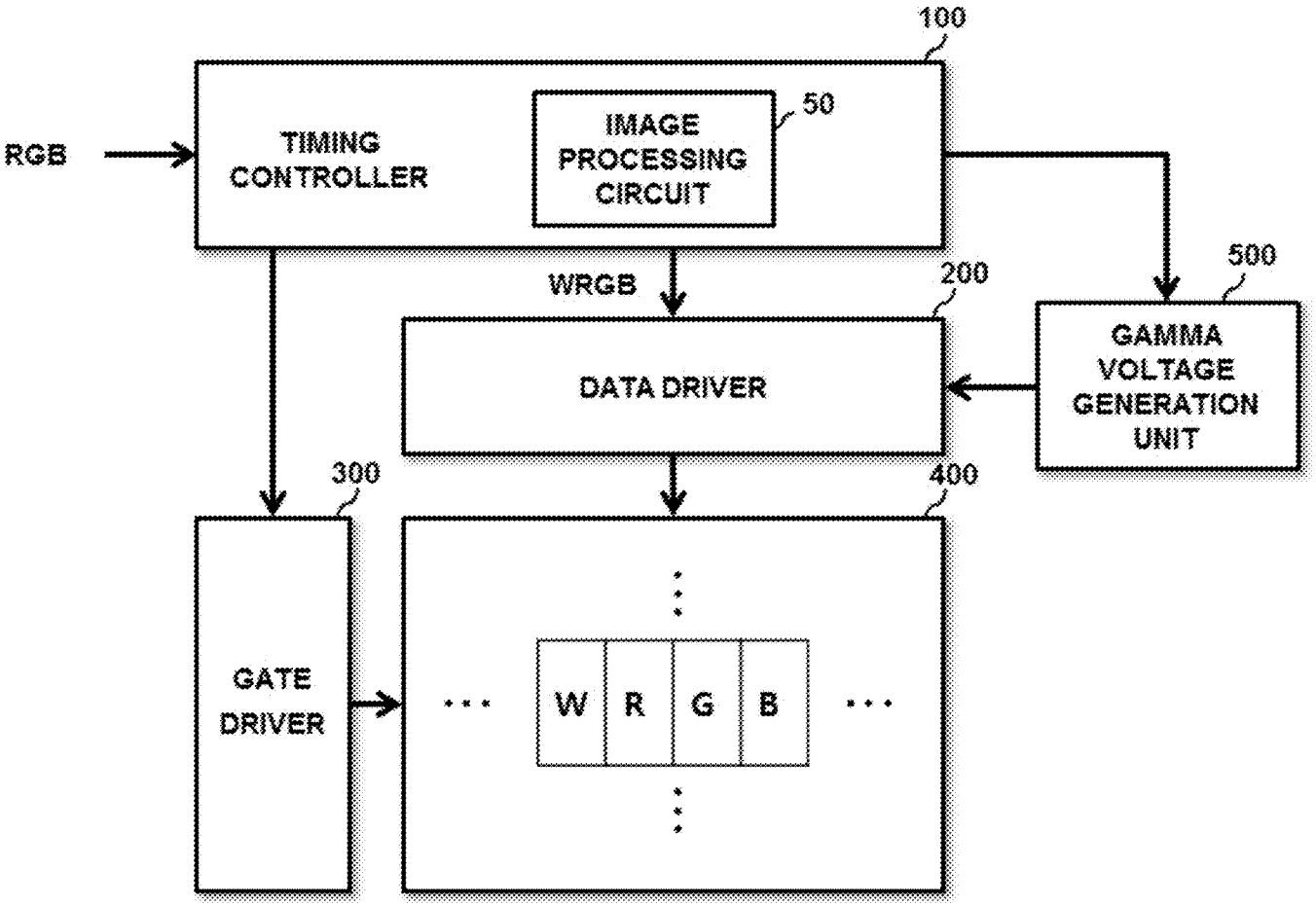
FIG. 1 is a block diagram schematically showing the construction of an organic light emitting diode (OLED) display device according to an embodiment of the present invention.

FIG. 1 is a block diagram schematically showing the construction of an organic light emitting diode (OLED) display device according to an embodiment of the present invention. The OLED display device shown in FIG. 1 includes, among other components, a panel driving unit, a display panel 400, a gamma voltage generation unit 500, and a power supply unit (not shown). The panel driving unit may include, among other components, a timing controller 100, a data driver 200 and a gate driver 300.

The timing controller 100 receives RGB data and a timing signal from an external host system, including but not limited to, a computer, a TV system, a set-top box, a tablet PC, and a portable terminal, such as a mobile phone. The timing controller 100 generates data control signals for controlling driving timing of the data driver 200 and gate control signals for controlling driving timing of the gate driver 300 using the received timing signal, outputs the generated data control signals to the data driver 200 and outputs gate control signals to the gate driver 300. The timing signal supplied from the host system to the timing controller 100 includes a dot clock, a data enable signal, a vertical synchronization signal, and a horizontal synchronization signal. In some embodiments, the vertical synchronization signal and the horizontal synchronization signal may be omitted. When the vertical synchronization signal and the horizontal synchronization signal are omitted, the timing controller 100 may count the data enable signal according to the dot clock to generate the vertical synchronization signal and the horizontal synchronization signal.

An image processing circuit 50 of the timing controller 100 detects a fixed image region using RGB data to divide the RGB data (representing an image using first color components) into RGB data for the fixed image region and RGB data for remaining regions other than the fixed image region. "Fixed image region" herein refers to a region of the display where a fixed image is displayed for longer than a predetermined amount of time. The fixed image region may include images such as a logo, a menu or icon of a mobile device. In addition, the image processing circuit 50 may also determine whether the fixed image is an opaque image (which may cause a ghost image problem) or a semitransparent image (which is unlikely to cause a ghost image problem). The image processing circuit 50 applies a luminous efficacy per color to RGB data of an opaque fixed image region based on different luminous efficacies per color and a cognitive ghost image allowance limit to convert the RGB data into WRGB data (representing the image using second color components) while correcting the luminance of the fixed image such that the change in color of the fixed image is not perceivable. WRGB data include one more color component (i.e., white color component) than RGB data. The image processing circuit 50 converts RGB data of a general region and RGB data of a semitransparent fixed image region into WRGB data using a general RGB-to-WRGB data conversion method. The image processing circuit 50 synthesizes the WRGB data of the fixed image region and the WRGB data of the general region, and outputs the synthesized WRGB data to the data driver 200. A detailed description of the image processing circuit 50 in connection with this will be made hereinafter.

In addition, the image processing circuit 50 may perform additional image processing, such as reduction of power consumption, correction of image quality, and correction of deterioration, and may output the data to the data driver 200. For example, the image processing circuit 50 may detect an average picture level (APL) using WRGB data, may decide peak luminance inversely proportional to the APL using a lookup table (LUT), and may adjust high potential voltage of the gamma voltage generation unit 500 based on the peak luminance to reduce power consumption. In addition, before adjusting the high potential voltage based on the peak luminance, the image processing circuit 50 may calculate total current per frame using the LUT, in which current values of the respective WRGB data are pre-stored, and may further adjust the peak luminance based on the total current.

Although FIG. 1 illustrates the image processing circuit 50 as being part of the timing controller 100, the image processing circuit 50 may also be embodied as a separate component between the timing controller 100 and the data driver 200 or at the input end of the timing controller 100.

The data driver 200 receives the data control signals and WRGB data from the timing controller 100. The data driver 200 is driven according to the data control signals to subdivide a set of reference gamma voltages supplied from the gamma voltage generation unit 500 into gray scale voltages corresponding to gray scale values of data, to convert digital WRGB data into analog WRGB data using the subdivided gray scale voltages, and to output the analog WRGB data to data lines of the display panel 400.

The data driver 200 includes a plurality of data drive ICs for separately driving the data lines of the display panel 400. Each data drive IC may be mounted on a circuit film, such as a tape carrier package (TCP), a chip on film (COF), or a flexible printed circuit (FPC), such that each data drive IC is attached to the display panel 400 by tape automatic bonding (TAB), or may be mounted on the display panel 400 by chip on glass (COG) technique.

The gate driver 300 drives a plurality of gate lines of the display panel 400 using the gate control signals received from the timing controller 100. In response to the gate control signals, the gate driver 300 supplies a scan pulse having a gate on voltage to each gate line for a scanning period, and supplies a gate off voltage to each gate line for the remaining period. The gate driver 300 may receive the gate control signals from the timing controller 100, or may receive the gate control signals from the timing controller 100 via the data driver 200. The gate driver 300 includes at least one gate IC. The gate IC may be mounted on a circuit film, such as a TCP, a COF, or an FPC, such that the gate IC is attached to the display panel 400 by TAB, or may be mounted on the display panel 400 by COG. Alternatively, the gate driver 300 may be formed on a thin film transistor substrate together with a thin film transistor array constituting a pixel array of the display panel 400 such that the gate driver 300 may be provided as a gate in panel (GIP) type gate driver mounted in a non-display region of the display panel 400.

Figure 2:
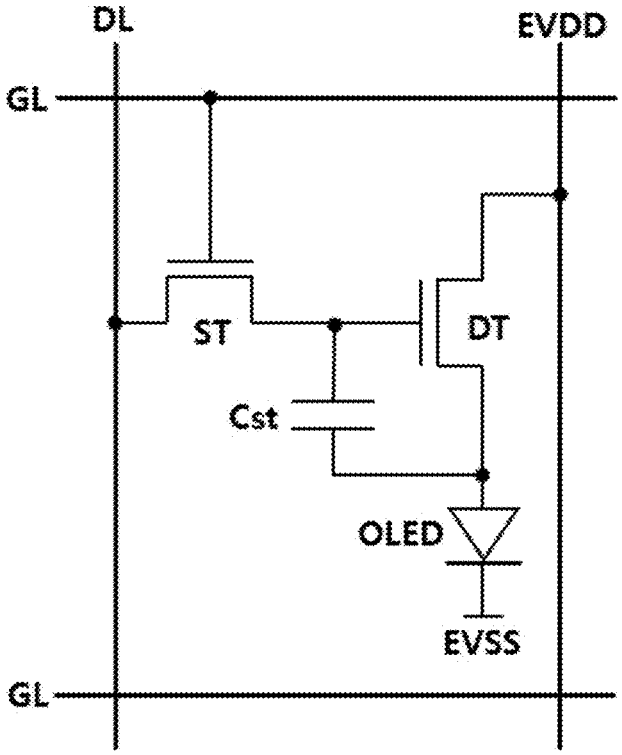
FIG. 2 is an equivalent circuit diagram showing the structure of each sub-pixel of FIG. 1, according to one embodiment.

The display panel 400 displays an image through a pixel array, in which pixels are arranged in a matrix form. Each pixel of the pixel array includes WRGB sub-pixels. As shown in FIG. 2, each of the WRGB sub-pixels includes an OLED element connected between a high potential voltage EVDD and a low potential voltage EVSS, and a pixel circuit connected to a data line DL and a gate line GL for driving the OLED elements. The pixel circuit includes at least a switching transistor ST, a driving transistor DT, and a storage capacitor Cst. The switching transistor ST charges the storage capacitor Cst with voltage corresponding to a data signal from the data line DL in response to a scan pulse from the gate line GL. The driving transistor DT controls current that is supplied to the OLED element based on the voltage charged in the storage capacitor Cst to adjust the amount of light emitted from the OLED element. The pixel circuit of each sub-pixel may have various structures, and therefore the pixel circuit of each sub-pixel is not limited to the structure shown in FIG. 2.

Figure 3:
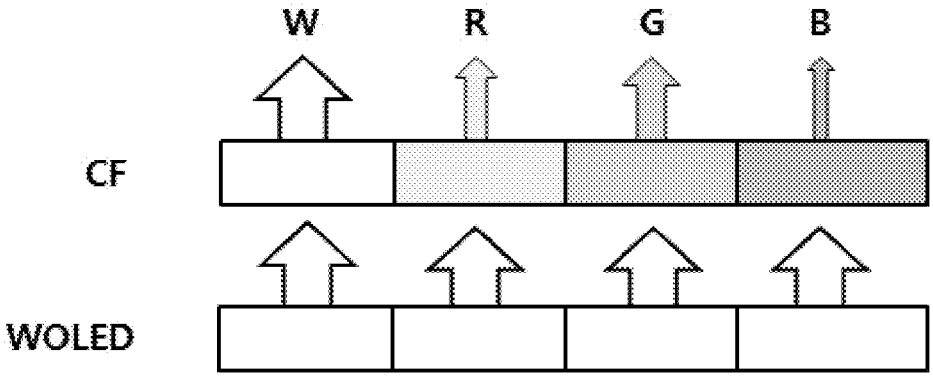
FIG. 3 is a conceptual diagram illustrating luminous efficacy of WRGB shown of FIG. 1.

Colors of the WRGB sub-pixels may be realized using white OLEDs (WOLEDs) and RGB color filters, or OLEDs of the WRGB sub-pixels may include WRGB light emitting materials to realize colors of the WRGB sub-pixels. For example, as shown in FIG. 3, RGB sub-pixels may include WOLEDs and RGB color filters CFs, and a W sub-pixel may include a WOLED and a transparent region other than the color filter. Each WOLED element outputs W light that includes all spectrum components of visible light. The RGB color filters CFs of the RGB sub-pixels filter spectrum components having corresponding wavelengths from W light to output RGB light, and the transparent region of the W sub-pixel outputs W light without change. When the WOLED elements output light having a luminance of 100% as shown in FIG. 3, the W sub-pixel has a higher luminous efficacy than the RGB sub-pixels, and the luminous efficacy sequentially decreases in the order of W, G, R, and B (B having the lowest luminous efficacy).

Meanwhile, the WRGB sub-pixels may have various array structures so as to improve color purity, improve color expression, and match target color coordinates. For example, the WRGB sub-pixels may have a WRGB array structure, an RGBW array structure, or an RWGB array structure.

The fixed image may be divided into an opaque fixed image and a semitransparent fixed image. In the opaque fixed image, a white color having a gray scale value above a threshold is continuously displayed. As a result, a ghost image problem is caused by deterioration of the OLED elements. However, the semitransparent fixed image is displayed at an intermediate gray scale of a gray scale value below a threshold. When semitransparent fixed images are displayed, the likelihood of a ghost image occurring is low. In the present invention, therefore, luminance correction is performed for the opaque fixed image region but not the transparent fixed image region to restrain deterioration of OLED elements.

Figure 4:
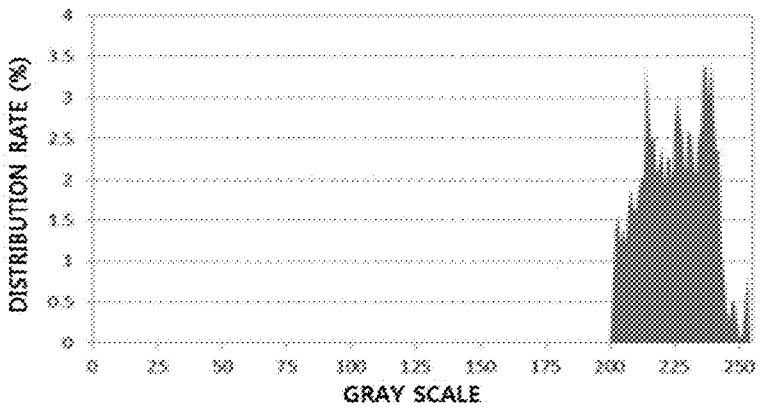
FIG. 4 is a distribution chart of gray scale based on characteristics of logo regions, in an example.
Figure 4:
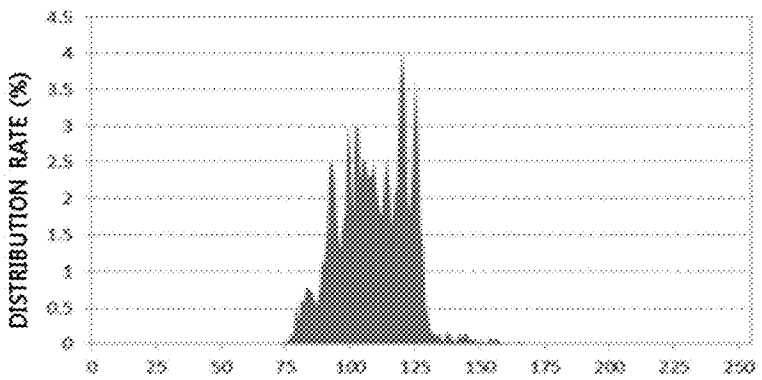

FIG. 4 is a view showing analysis of an opaque logo as the opaque fixed image and a semitransparent logo as the semitransparent fixed image. As shown in FIG. 4, after displaying of 100 frames of an opaque logo in a region, gray scales of logo are distributed only in a high gray scale portion whereas after displaying 100 frames of a semitransparent logo in a region, gray scales of logo are distributed in only an intermediate gray scale portion. Based on the distribution of gray scale distribution, it is possible to determine whether the fixed image is opaque or semitransparent. Based on the determination, a luminance correction for an opaque fixed image region can be performed to prevent or reduce the ghost image effect.

Figure 5:
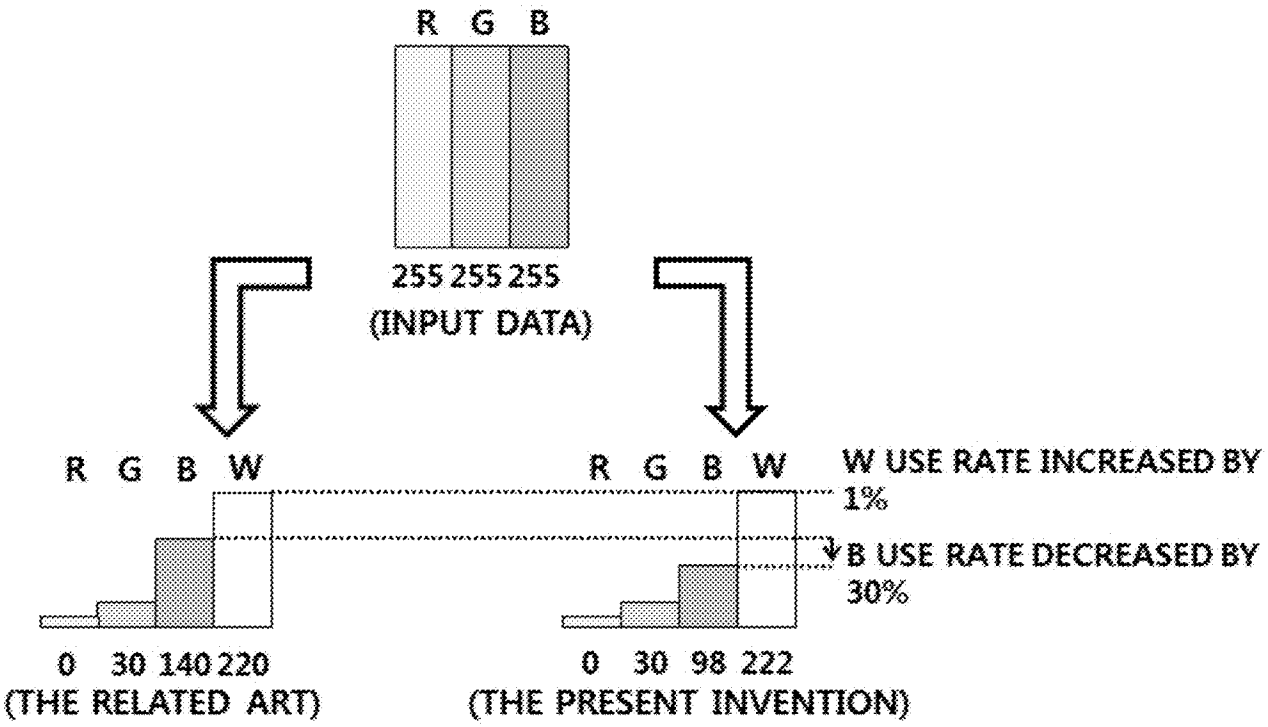
FIG. 5 is a conceptual diagram illustrating an RGB-to-WRGB data conversion method for an opaque fixed image region, according to an embodiment of the present invention.

FIG. 5 is a conceptual diagram illustrating an RGB-to-WRGB data conversion for an opaque fixed image region according to one embodiment of the present invention. When RGB data indicating white in an opaque fixed image are converted into WRGB data, WGB data or WRB data may be adjusted without using R or G data to reduce luminance. For example, input linear R(255), G(255), and B(255) data of an opaque fixed image shown in FIG. 5 may be converted into W(220), R(0), G(30), and B(140) data of an opaque fixed image of the related art to reduce luminance.

As previously described, luminous efficacy of the WRGB sub-pixels sequentially decreases in the order of W, G, R and B. For example, a ratio in luminous efficacy of the WRGB sub-pixels may be W:G:R:B=30:10:3:1. In order to provide the same luminance, therefore, the B sub-pixels may be driven with 30 times more energy than the W sub-pixels. When B sub-pixels are driven at such intensity or duration, the lifespan of the B sub-pixels becomes shortened, causing a white logo to become yellow, and a logo ghost image problem to occur.

In order to solve this problem, a use rate of the B sub-pixels in the fixed image (logo) region is decreased, and instead, the use rate of any one of WRG is increased to restrain deterioration of the B sub-pixels having low efficacy as shown in the right side of FIG. 5. Such modification results in the same level of luminance as the related art (the left side of FIG. 5). The use rate of a sub-pixel as described herein refers to current through the sub-pixel during a predetermined amount of time. For example, as shown in FIG. 5, a use rate of the B sub-pixels of the embodiment may be reduced by 30% while increasing a use rate of the W sub-pixels may be increased by only 1% to reduce deterioration of the B sub-pixels and maintain the same level of luminance. In other words, it is possible to reduce deterioration of the B sub-pixels and thus reduce or prevent a ghost image issue due to the fixed image by adjusting data representing the use rate of B sub-pixels to reduce the use rate of B sub-pixels by 30%, and adjusting data representing the use rate of W sub-pixels to increase the use of B sub-pixels by only 1%. Such adjustment considerably increases the lifespan of the B sub-pixels.

Figure 6:
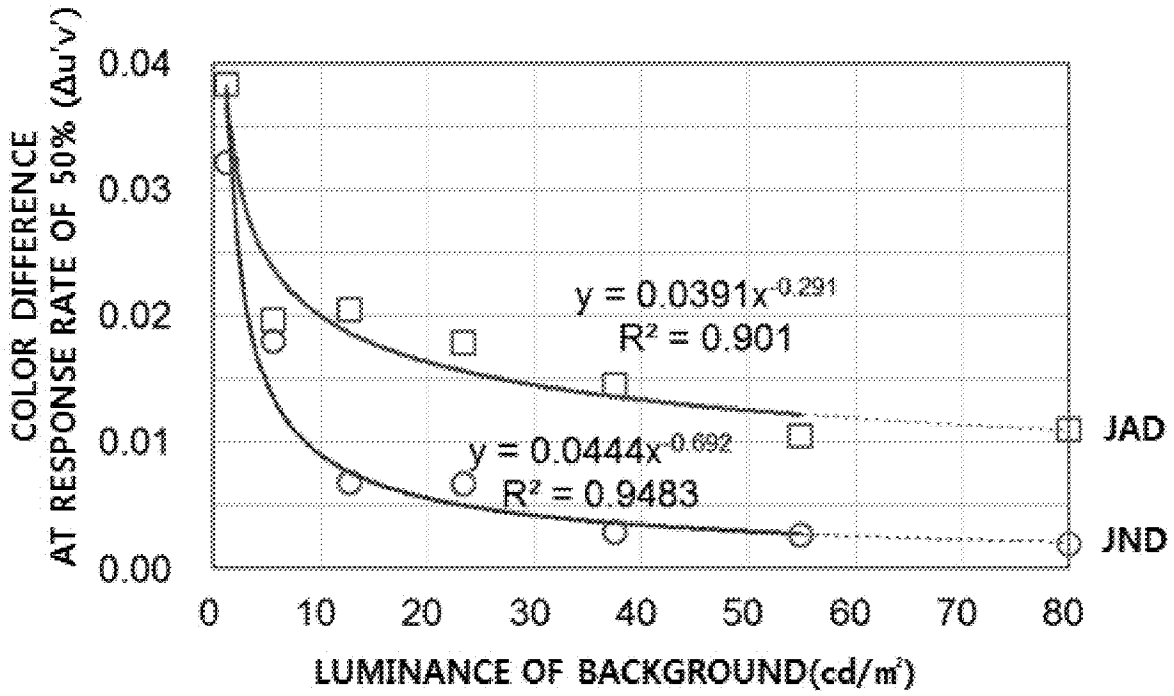
FIG. 6 is a graph showing cognitive characteristics of a ghost image of a logo based on the luminance of a background applied to an embodiment of the present invention.

FIG. 6 is a graph showing the characteristics of a color difference Δu'v' of a just noticeable difference (IND) and a just acceptable difference (JAD) of a ghost image of a yellow logo based on the luminance of a background of the OLED display device applied to an embodiment of the present invention. u' and v' herein refer to chromacity coordinates in a color space. In FIG. 6, y axis indicates persons' noticing or accepting color difference at 50% response rate (i.e., 50% of people notices color difference). Specifically, a JND graph indicating persons' noticing of the color difference Δu'v' of a yellow logo region in a white background at 50% JND response rate is expressed in a trend line having the equation of $y=0.0444x^{-0.692}$ (where goodness of fit is represented as $R^2=0.9483$). Using this equation, the 50% JND at the luminance of 80 cd/m$^2$ is derived as 0.002. A JAD graph indicating persons accepting color difference at 50% response rate (i.e., 50% of people indicating that the color difference is acceptable) is expressed in a trend line having the equation of $y=0.0391x^{-0.291}$ (where goodness of fit is represented as $R^2=0.901$). Using this equation, the 50% JAD at the luminance of 80 cd/m$^2$ is derived as 0.011.

In the embodiments of the present invention, the luminance of the logo region is corrected based on the color difference Δu'v' of the allowance limit (JAD) of the after-image of the yellow logo, which is 0.011 (at luminance of 80 cd/m$^2$), thereby preventing recognition of change in color due to deterioration of the logo region. It is possible to set a criterion of deterioration correction for the fixed image region based on the luminance efficacies of the WRGB sub-pixels described with reference to FIG. 5 and the recognition test result described with reference to FIG. 6.

When the luminance of the fixed image region is corrected, the driving quantity of the B sub-pixels, which have low luminous efficacy, is decreased, and the reduction in luminance as the result thereof is supplemented by increasing the driving amount of the W sub-pixels, which have high luminous efficacy. The total luminance of the WRGB sub-pixels is adjusted to maintain a level within JAD be (0.011) of the color difference Δu'v' with the original fixed image, i.e. the deterioration recognition allowance limit.

The use rate of the sub-pixels per color may be adjusted by applying different weights (gain) to data per color. As previously described, a ratio in luminous efficacy of the WRGB sub-pixels is W:G:R:B=30:10:3:1. Consequently, the W sub-pixels exhibit 30 times higher luminous efficacy than the B sub-pixels. One of the weights per color (e.g. a B weight) may be reduced to a value less than 1, and a weight equivalent to 1/30 of the decrement of the B weight may be added to a W weight to correct luminance. At this time, the weights per color are set based on the luminance correction and deterioration recognition allowance limit.

In one embodiment, a B weight α and a W weight β is set while maintaining the total luminance Ytotal(logo) of the WRGB sub-pixels in the logo region as represented by the following equations:

$$Y\text{total(logo)}=Y(R)+Y(G)+Y(B)+Y(W)=Y(R)+Y(G)+\alpha^*Y(B)+\beta^*Y(W) \quad (1)$$

$$\alpha=0.8(<1) \quad (2)$$

$$\beta=1.007(>1)=1+1/30^*(1-\alpha) \quad (3)$$

Referring to Equation (1), B luminance Y(B) is decreased by the weight α which is less than 1, and 1/30 of its decrement is added to the W weight β. The weight (α, β) may be preset by designers of the display device, and may be stored in a memory of image processing circuit 50.

Figure 7:
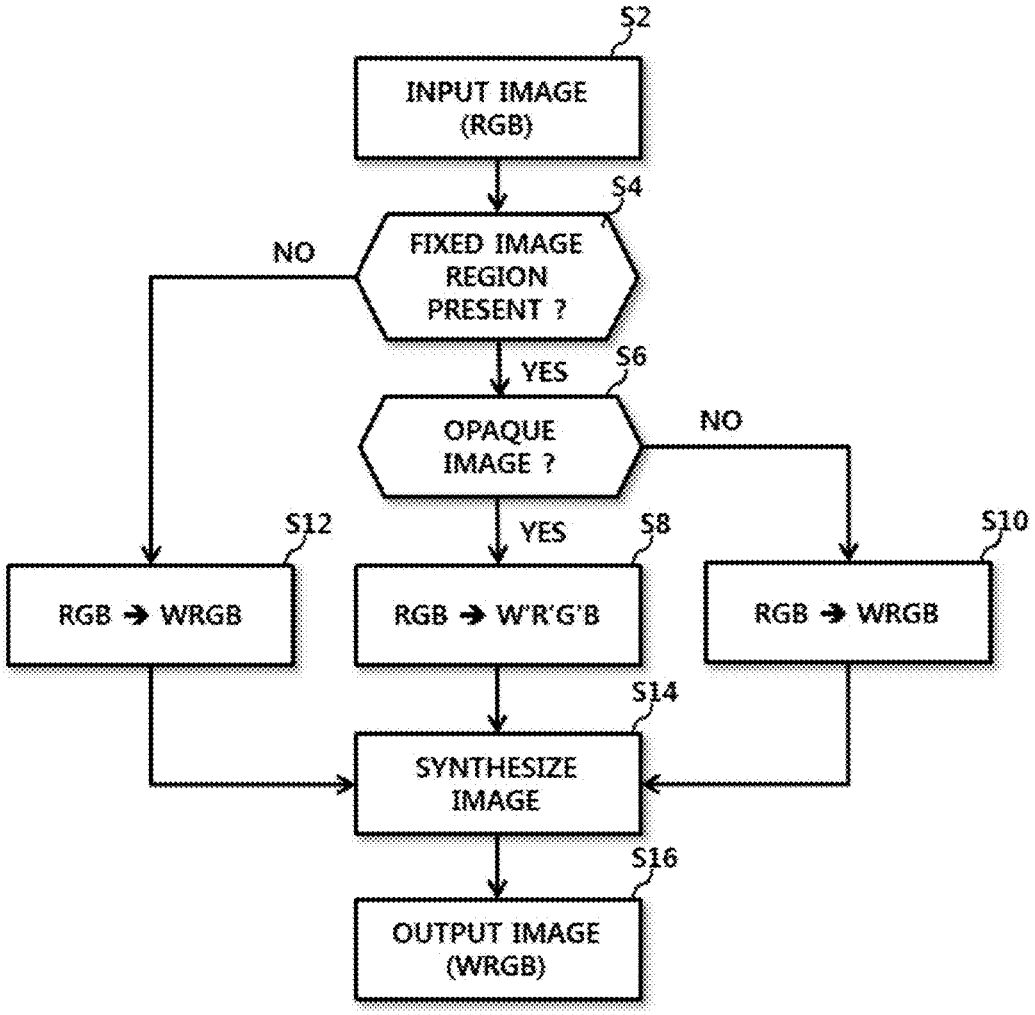
FIG. 7 is a flowchart showing illustrating an image processing method according to an embodiment of the present invention.
Figure 8:
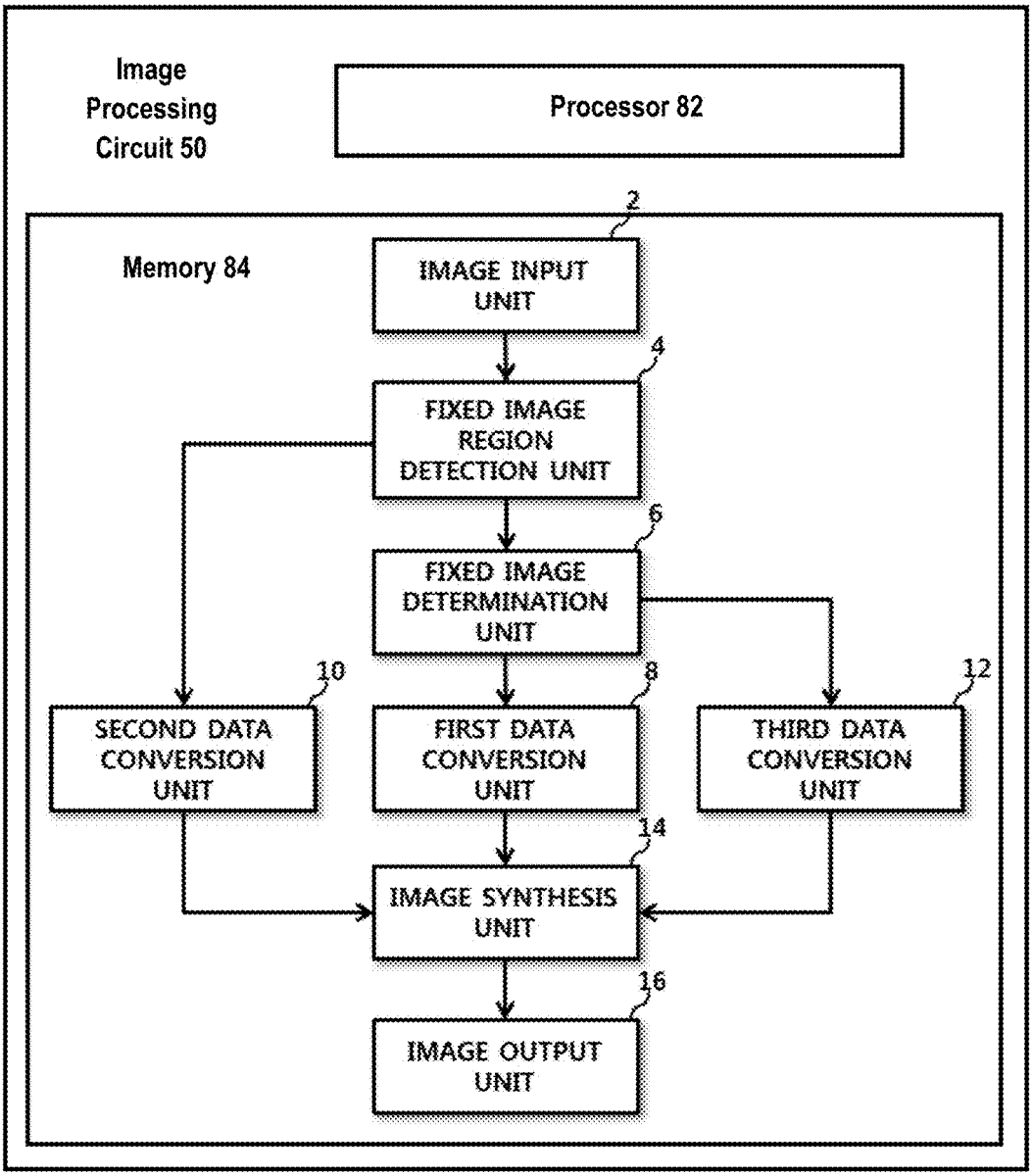
FIG. 8 is a schematic block diagram illustrating components of an image processing circuit according to an embodiment of the present invention.

FIG. 7 is a flowchart showing illustrating an image processing method according to an embodiment of the present invention. FIG. 8 is a schematic block diagram illustrating components of the image processing circuit 50 according to an embodiment of the present invention. The image processing method of FIG. 7 is performed by the image processing circuit shown in FIG. 8. Consequently, the following description will be made with reference to both FIGS. 7 and 8.

The image processing circuit 50 may include, among other components, a processor 82 and a memory (non-transitory computer readable storage medium) 84. The memory 84 may store modules including, an image input unit 2, a fixed image region detection unit 4, a fixed image determination unit 6, first to third data conversion units 8, 10, and 12, an image synthesis unit 14, and an image output unit 16. The image input unit 2 and the image output unit 16 may be omitted. The processor 82 executes instructions stored in the memory 84 to perform operations as described herein.

The fixed image region detection unit 4 receives S2 RGB data as an input image through the image input unit 2. The fixed image region detection unit 4 analyzes the received RGB data to determine whether a fixed image region is present in the input image.

After determining S4 that the fixed image region is present in the input image, the fixed image region detection unit 4 outputs RGB data of the fixed image region to the fixed image determination unit 6. When the fixed image region is not present in the input image, the fixed image region detection unit 4 outputs RGB data of a general region to the second data conversion unit 10. In other words, the fixed image region detection unit 4 divides the received RGB data into RGB data of a fixed image region and RGB data of a general region, outputs the RGB data of the fixed image region to the fixed image determination unit 6, and outputs the RGB data of the general region to the second data conversion unit 10.

To detect a fixed image region, the fixed image region detection unit 4 may compare RGB data between adjacent frames during a plurality of frames and identify a region having identical or similar data across the plurality of frames. Alternatively, coordinate information for a fixed image region may be received from a source external to the image processing circuit 50, and the fixed image region detection unit may locate a fixed image region corresponding to the coordinate information provided from the source. Various other known technologies for detecting a fixed image region or a logo region may be applied. The fixed image region detection unit 4 outputs the RGB data belonging to the detected fixed image region to the fixed image determination unit 6, and outputs the RGB data that do not belong to the fixed image region (i.e., the RGB data belonging to the general region) to the second data conversion unit 10.

The fixed image determination unit 6 determines S6 whether a fixed image is opaque or semitransparent using the RGB data of the fixed image region received from the fixed image region detection unit 4. When it is determined that the fixed image is opaque, the fixed image determination unit 6 outputs the RGB data to the first data conversion unit 8. When it is determined that the fixed image is semitransparent, the fixed image determination unit 6 outputs the RGB data to the third data conversion unit 12.

One way of determining whether the fixed image is opaque or semitransparent is by using a gray scale value obtained by accumulating and averaging across a fixed image received from the fixed image region detection unit 4 during a plurality of frames. If the gray scale value is of a specific value or more (e.g., 200 or more in 8 bit grayscale), the fixed image determination unit 6 determines that the fixed image is opaque, and outputs the RGB data to the first data conversion unit 8. When the gray scale value is less than the specific value, the fixed image determination unit 6 determines that the fixed image is transparent, and outputs the RGB data to the third data conversion unit 12.

The first data conversion unit 8 applies a luminous efficacy preset per color to the RGB data of the opaque fixed image region received from the fixed image determination unit 6 based on different luminous efficacies of each color and a cognitive ghost image allowance limit to correct the luminance of the fixed image and to convert S8 the RGB data into W'R'G'B' data. For example, in order to reduce deterioration of sub-pixels in the fixed image region, the total luminance of WRGB data may be adjusted so that the total luminance of WRGB data is lower than the total luminance of the original RGB data over time. At this time, within a cognitive allowance limit, a B weight $\alpha$ set to be less than 1 may be applied to reduce B data, and a W weight $\beta$ (equivalent to addition of 1/30 of the decrement of the B weight) may be applied to W data to correct luminance.

The third data conversion unit 12 converts S10 the RGB data of the semitransparent fixed image region received from the fixed image determination unit 6 into WRGB data using a general RGB-to-WRGB data conversion method that is well known in the art.

The second data conversion unit 10 converts S12 the RGB data of the general region received from the fixed image region detection unit 4 into WRGB data using a general RGB-to-WRGB data conversion method that is well known in the art.

The first to third data conversion units 8, 10, and 12 may also perform de-gamma processing for inverse gamma into linear luminance data per color, adjustment of luminance per each color, and gamma processing into WRGB data.

The image synthesis unit 14 synthesizes S14 the W'R'G'B' data of the fixed image region from the first data conversion unit 8 or the WRGB data of the fixed image region from the third data conversion unit 12 and the WRGB data of the general region from the second data conversion unit 10, and outputs S16 the synthesized WRGB data to the data driver 200 through the image output unit 16. At this time, the image synthesis unit 14 may synthesize the W'R'G'B' data or the WRGB data of the fixed image region and the WRGB data of the general region to generate and output a corrected image that is capable of minimizing abrupt reduction of B data in the fixed image region.

The OLED display device according to the embodiment of the present invention may be applied to various kinds of electronic devices, such as a video camera, a digital camera, a head mount display (goggle type display), a car navigation system, a projector, a car stereo, a personal computer, a portable information terminal (a mobile computer, a mobile phone, or an electronic book reader), and a TV set.

As described above, the image processing method and circuit of the embodiments increase or decrease color components based on luminous efficacies for each color component and the likelihood of causing ghost images to modulate data of a fixed image region, thereby reducing deterioration and color distortion of the fixed image region and extending the lifespan of a display device.

As is apparent from the above description, the image processing method and circuit according to the present invention and the OLED display device using the same discriminatively apply a weight per color in consideration of different luminous efficacies per color and a cognitive after-image allowance limit to modulate data of a fixed image region, thereby reducing deterioration and color distortion of the fixed image region and extending a lifespan.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method of processing image data for displaying on a display device, comprising:

determining a first image region of the image data and a second image region of the image data, the first image region more likely to cause a ghost image effect than the second image region, the image data represented by first color components;

applying a first conversion algorithm to first pixel data of the first image region to obtain first converted pixel data represented by second color components, a number of the second color components more than a number of the first color components; and applying a second conversion algorithm to second pixel data of the second image region to obtain second converted pixel data represented by the second color components, wherein the first conversion algorithm increases a use rate of a first component of the second color components and decreases a use rate of a second component of the second color components relative to the second conversion algorithm, the first component having a higher luminous efficacy than the second component, wherein the first conversion algorithm generates $\alpha$ times the use rate of the first component and $\beta$ times the use rate of the second component relative to the second conversion algorithm, where $\beta=1+1/30*(1-\alpha)$.

2. The method of claim 1, wherein the ratio of decrease in the use rate of the second component relative to the increase in the use rate of the first component corresponds to a ratio of luminous efficacies of the first component and the second component.

3. The method of claim 1, wherein the first image region includes an opaque fixed image and the second image region does not include a fixed image.

4. The method of claim 3, wherein the image data includes a third image region including a semitransparent fixed image, wherein the second conversion algorithm is applied to third pixel data of the third image region to obtain the third converted pixel data.

5. The method of claim 4, wherein a gray scale distribution is used to distinguish the first image region and the third image region.

6. The method of claim 1, wherein the first color components are red, green and blue, and the second color components are white, red, green and blue.

7. The method of claim 6, wherein the first component is white and the second component is blue.

8. The method of claim 1, further comprising synthesizing the first pixel data and the second pixel data into a converted image data.

9. An image processing circuit, comprising:

a fixed image region detection unit configured to determine a first image region of the image data and a second image region of the image data, the first image region more likely to cause a ghost image effect compared to the second image region, the image data represented by first color components;

a first data conversion unit configured to apply a first conversion algorithm to first pixel data of the first image region to obtain first converted pixel data represented by second color components, a number of the second color components more than a number of the first color components; and a second data conversion unit configured to apply a second conversion algorithm to second pixel data of the second image region to obtain second converted pixel data represented by the second color components, wherein the first conversion algorithm increases a use rate of a first component of the second color components and decreases a use rate of a second component of the second color components relative to the second conversion algorithm, the first component having a higher luminous efficacy than the second component, wherein the first conversion algorithm generates $\alpha$ times the use rate of the first component and $\beta$ times the use rate of the second component relative to the second conversion algorithm, where $\beta=1+1/30*(1-\alpha)$.

10. The image processing circuit of claim 9, wherein the ratio of decrease in the use rate of the second component relative to the increase in the use rate of the first component corresponds to a ratio of luminous efficacies of the first component and the second component.

11. The image processing circuit of claim 9, wherein the first image region includes an opaque fixed image and the second image region does not include a fixed image.

12. The image processing circuit of claim 11, further comprising a third data conversion unit configured to apply the second conversion algorithm to third pixel data of third image region to obtain the third converted pixel data, the third image region including a semitransparent fixed image.

13. The image processing circuit of claim 12, further comprising a fixed image determination unit configured to distinguish the first image region and the third image region using a gray scale distribution.

14. The image processing circuit of claim 9, wherein the first color components are red, green and blue, and the second color components are white, red, green and blue.

15. The image processing circuit of claim 14, wherein the first component is white and the second component is blue.

16. The image processing circuit of claim 9, further comprising an image synthesis unit configured to synthesize the first pixel data and the second pixel data into a converted image data.

17. A display device comprising:

an organic light emitting diode (OLED) display panel including gate lines, data lines intersecting with the gate lines and OLEDs;

a gate driver configured to generate gate control signals transmitted on the gate lines;

an image processing circuit, comprising:

a fixed image region detection unit configured to determine a first image region of an image data and a second image region of the image data, the first image region more likely to cause a ghost image effect compared to the second image region, the image data represented by first color components, a first data conversion unit configured to apply a first conversion algorithm to first pixel data of the first image region to obtain first converted pixel data represented by second color components, a number of the second color components more than a number of the first color components, and a second data conversion unit configured to apply a second conversion algorithm to second pixel data of the second image region to obtain second converted pixel data represented by the second color components, wherein the first conversion algorithm increases a use rate of a first component of the second color components and decreases a use rate of a second component of the second color components relative to the second conversion algorithm, the first component having a higher luminous efficacy than the second component; and a data driver configured to generate analog pixel data corresponding to the first and second converted pixel data for transmitting on the data lines, wherein the first conversion algorithm generates $\alpha$ times the use rate of the first component and $\beta$ times the use rate of the second component relative to the second conversion algorithm, where $\beta=1+1/30*(1-\alpha)$.

18. The display device of claim 17, wherein the ratio of decrease in the use rate of the second component relative to the increase in the use rate of the first component corresponds to a ratio of luminous efficacies of the first component and the second component.

* * * * *